US007270389B2

(12) United States Patent
Inoue et al.

(10) Patent No.: US 7,270,389 B2
(45) Date of Patent: Sep. 18, 2007

(54) INK JET RECORDING APPARATUS AND INK JET RECORDING METHOD

(75) Inventors: Tomoyuki Inoue, Kanagawa (JP); Minoru Nozawa, Kanagawa (JP); Hiroshi Yamada, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 4 days.

(21) Appl. No.: 10/424,095

(22) Filed: Apr. 28, 2003

(65) Prior Publication Data

US 2004/0017426 A1 Jan. 29, 2004

(30) Foreign Application Priority Data

May 2, 2002 (JP) ..... 2002-130407
Apr. 25, 2003 (JP) ..... 2003-121611

(51) Int. Cl.
*B41J 29/38* (2006.01)

(52) U.S. Cl. ..... 347/11; 347/12; 347/9

(58) Field of Classification Search ..... 347/10, 347/11, 17, 19, 35, 60, 12, 44, 13
See application file for complete search history.

(56) References Cited

U.S. PATENT DOCUMENTS 5,638,100 A * 6/1997 Kanematsu et al. ..... 347/35
5,894,314 A 4/1999 Tajika et al. ..... 347/14
6,139,126 A * 10/2000 Ayata et al. ..... 347/13
6,286,923 B1 * 9/2001 Sugahara ..... 347/10
6,331,039 B1 * 12/2001 Iwasaki et al. ..... 347/11
6,428,134 B1 * 8/2002 Clark et al. ..... 347/10
6,499,821 B1 12/2002 Nozawa ..... 347/14

FOREIGN PATENT DOCUMENTS

EP 0 694 403 1/1996
EP 0 997 278 5/2000
EP 1176018 A2 * 1/2002

* cited by examiner

*Primary Examiner*—Lam Son Nguyen
(74) *Attorney, Agent, or Firm*—Fitzpatrick, Cella, Harper & Scinto

(57) ABSTRACT

An ink jet recording apparatus can effectively extend its lifetime with regard to disconnection without acceleration of deterioration of the heater element with aging, and can avoid adverse effects owing to its use environment, the deteriorated state of the heater element, scattering in recording heads at manufacturing, and the like. Because deterioration of recorded images caused by disconnection in heaters can be avoided, stable image quality can be obtained. The ink jet recording apparatus has a plurality of heater elements in a recording head thereof, for ejecting ink by heating of the heater elements, and includes a control unit for executing driving control of the heater elements. The same heater element is driven for recording under different driving conditions, independently of recording data.

7 Claims, 14 Drawing Sheets

P1 : PREHEAT PULSE (= T1)
P2 : INTERVAL TIME (= T2−T1)
P3 : MAIN HEAT PULSE (= T3−T2)
Vop : DRIVING VOLTAGE

| | SINGLE PULSE (NO DIVISION) | DOUBLE PULSE (TWO DIVISION) |
|---|---|---|
| P1 | 0 | 0.7 μ sec |
| P2 | 0 | 0.3 μ sec |
| P3 | 20 μ sec | 1.4 μ sec |
| Vop | 19V | 19V |

INK JET RECORDING APPARATUS AND INK JET RECORDING METHOD

BACKGROUND OF THE INVENTION

1. Field of the Invention

The present invention relates to an ink jet recording apparatus and an ink jet recording method for recording by ejecting ink through a nozzle whenever a driving signal is applied.

2. Related Background Art

The ink jet recording apparatus has advantages that it is comparatively easy to reduce the size of a recording head and it is possible to record a high resolution image at high speed at less running cost.

Particularly, since a heater element, for the recording head according to a bubble-jet method in which ink is ejected by using thermal energy, which gives heat to ink, can be formed on a substrate by deposition through a semiconductor manufacturing process, the recording head can be manufactured in a very small size.

In a recording apparatus according to the bubble-jet method (thermal ink jet method) in which ink is ejected by using such thermal energy, as the total number of recorded sheets increases, the number of times of starting the recording apparatus increases, and the number of times of ink ejecting exceeds a predetermined threshold value, disconnection breakdown has frequently occurred in a heater (heater element) of a recording element, preventing ink from being ejected thereby.

In the bubble-jet method, ink is ejected with repeating processing in which a bubble is generated, grown and shrunk, based on heating by a heater element. One of the causes for the above disconnection breakdown is the breakdown of the heater element (which may include a protective film), which breakdown is caused by centering of an impact force on a fixed location of the heater, which force is caused when a physical impact (hereinafter called "cavitation") is applied to the heater element upon defoaming of the bubble. The physics of cavitation will be explained, referring to drawings.

FIGS. 15A, 15B, 15C and 15D are explanatory views of the physics of cavitation. In FIG. 15A, 150 shows an exemplary view of an ink flow channel and 8C is an ejecting heater (heater element). When energy is applied on the ejecting heater 8C, the temperature of ink near the surface of the ejecting heater is raised to cause a change in state from liquid to gas through phase transition and a bubble 152 is generated. The pressure level of foaming gas at a start point of foaming is raised to a level approximately exceeding 10 atmospheres and, thereafter, the pressure in the gas is reduced to 1/100 atmospheres or less when the bubble reaches the maximum foaming point only by inertia force (FIG. 15A). Then, shrinking force is generated by the lower pressure in the gas and defoaming is started (FIG. 15B).

Refilling of ink is started along with shrinkage of the gas and inertia force is generated in ink once ink is started to move. In the middle of defoaming, the pressure in the bubble is in a state of negative pressure relative to the atmospheric pressure and the shrinking force is applied on the bubble in the shrinking direction by which the bubble itself is shrunk. From a certain point in time, the shrinkage advances while the bubble is pushed and crushed by the inertia force of the ink and the pressure in the gas becomes extremely high. When the gas is compressed to the limit (FIG. 15C), the gas cannot exist in a vapor phase and defoaming processing is completed (FIG. 15D) after phase transition to a liquid phase.

The process advances with extremely high speed. When the above-described recording head was driven under the above-described conditions, the time required from the point when the bubble reached the maximum foaming point to the point at completion of defoaming was approximately 5 μs. Here, the pressure level is instantaneously changed from an extremely high state to the normal pressure (ink pressure open to the atmosphere) at phase transition of the final step in the above process. The impact force caused by the pressure change on the surface of the ejecting heater is cavitation. In order to prevent reduction in the lifetime with regard to disconnection in the heater caused by the cavitation, a protective film for anti-cavitation has been required to be provided on the heater.

However, the protective film for anti-cavitation causes reduction in the transmission efficiency of the thermal energy from the heater to ink and the efficiency of the energy used for ejecting is decreased. More particularly, when the film thickness is increased to improve the strength, the energy efficiency is further remarkably reduced. Thereby, there has been a problem to be solved, the problem being that the temperature of the recording head itself is easily raised to an extremely high temperature.

The present invention has been made, considering the above-described problems, and an object of the invention is to provide an ink jet recording apparatus and an ink jet recording method, by which stable image quality can be obtained together with an effectively extended lifetime with regard to the disconnection and without decreasing the efficiency of energy used for ejecting, because the deterioration of recorded images caused by disconnection in heaters is controlled without acceleration of deterioration of the heater element and without adverse effects owing to use environment, the deteriorated state of the heater element, scattering in recording heads at manufacturing, and the like.

SUMMARY OF THE INVENTION

In order to achieve the above-described object, according to an aspect of the invention, there is provided an ink jet recording apparatus, which comprises a plurality of heater elements and which heats ink by driving the heater elements to eject the ink, wherein control means drives the same heater elements for recording by changing driving conditions every predetermined number of ejecting operations, independently of image data.

Also, in order to achieve the above-described object, according to another aspect of the invention, there is provided a recording method for recording by using an ink jet head which comprises a plurality of heater elements and heats ink by driving the heater elements to eject the ink, the method comprising a step of driving the same heater elements for recording by changing driving conditions every predetermined number of ejecting operations to eject the ink, independently of image data.

DETAILED DESCRIPTION OF THE PREFERRED EMBODIMENTS

Hereinafter, embodiments according to the present invention will be explained, referring to attached drawings.

First Embodiment

Figure 2:
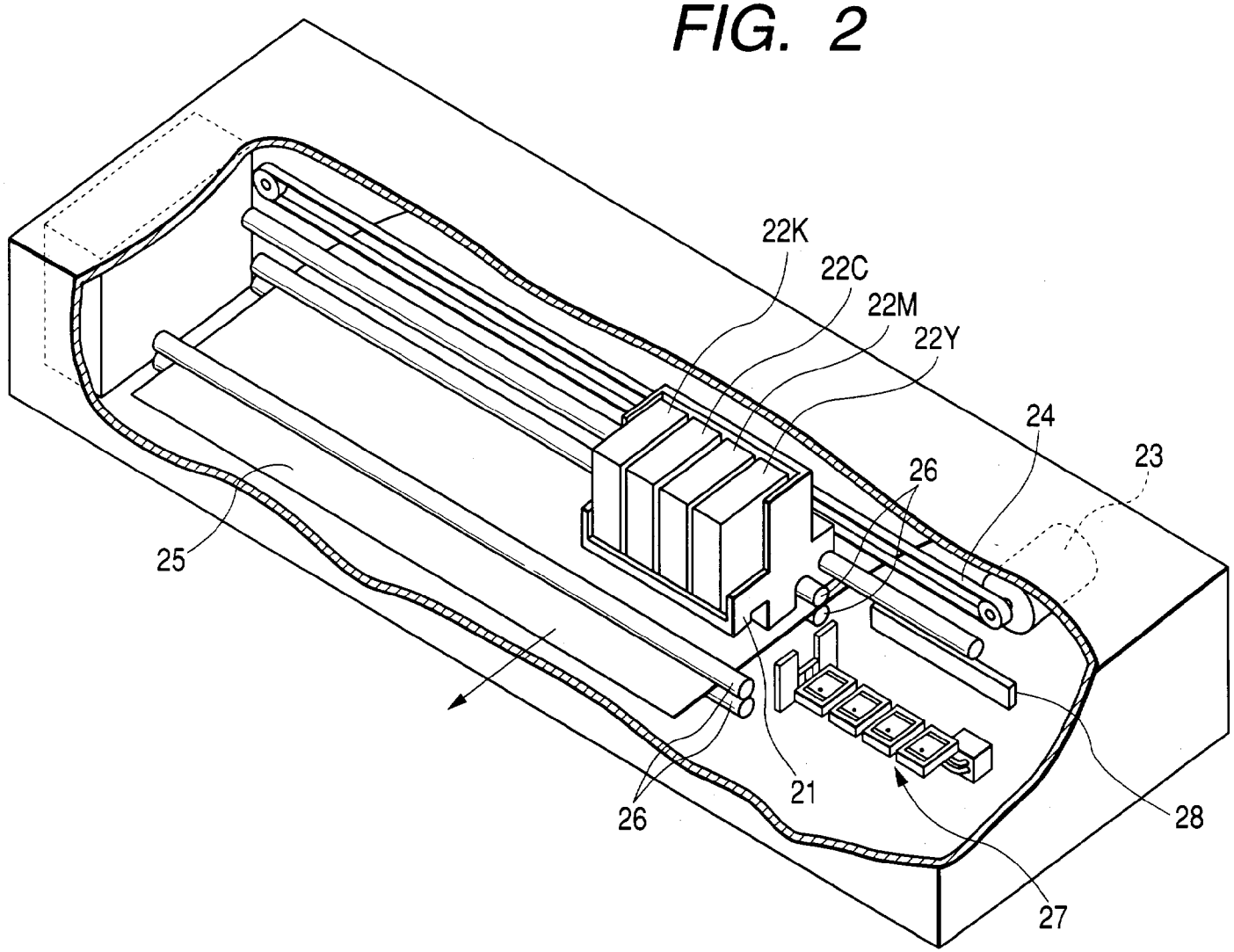
FIG. 2 is a view showing a schematic configuration of an ink jet recording apparatus.

FIG. 2 is a view showing a configuration of principal sections of an example of an ink jet recording apparatus to which the present invention can be applied.

In FIG. 2, 21 is a recording head, which is provided with four ink tanks 22 for colors of K (black), C (cyan), M (magenta), and Y (yellow) in the present embodiment. The recording head 21 is connected to a part of a driving belt 24 which transmits driving force of a driving motor 23, by which reciprocating motion of the head can be realized. Ink droplets are ejected onto a recording medium 25 such as recording paper for printing while reciprocating motion of the recording head is executed under a state that a small gap is kept between the recording medium 25 and the head.

In FIG. 2, the recording medium 25 is conveyed in a direction perpendicular to the moving direction of the recording head 21 by a paper feeding and conveying mechanism 26. The recording medium 25 is conveyed by a predetermined pitch amount after every one line of recording and the next line of recording is then executed. Such recording operations are repeated thereafter to form an image all over the recording medium 25.

A suction recovery cap 27, which removes foreign substances, such as thickened ink, stuck ink, dirt and bubbles, in each ejecting port by forced ejecting of ink from each ejecting port of the recording head 21, and thus recovers a normal ejecting function, is disposed at a predetermined position (for example, a home position) which is within a range of the reciprocating motion of the recording head 21 and outside a recording area. The suction recovery cap 27 caps the recording head 21 while printing is not executed, in order to prevent ink evaporation. Preliminary ejecting by which recovery processing is executed by ejecting ink to the cap can be also executed.

Figure 3:
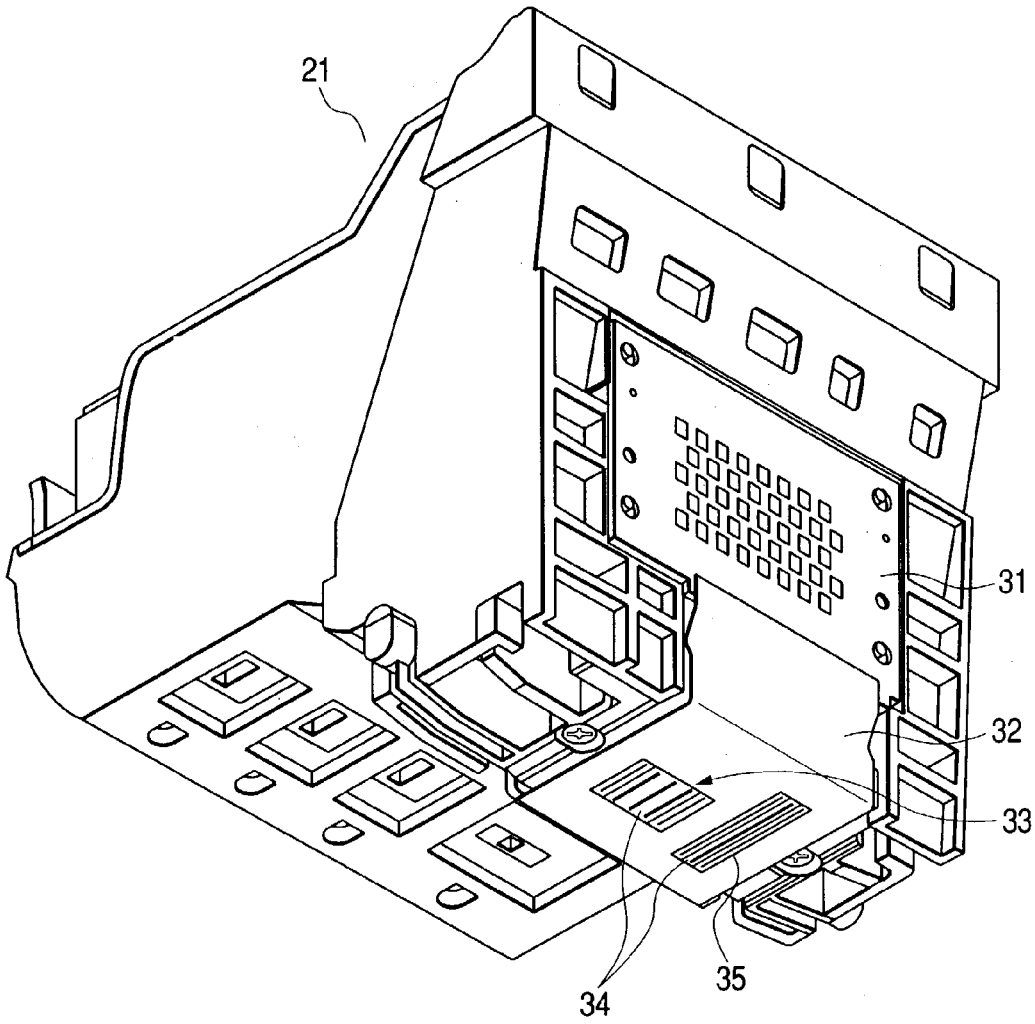
FIG. 3 is a view showing a schematic configuration of the ink jet recording head.

The recording head 21 will now be explained. FIG. 3 is a schematic view of the recording head 21. Driving information is sent from a host computer (for example, a personal computer) to an ink jet recording apparatus and a signal output from driving control means of the recording apparatus is transmitted to the recording head 21 through an electric contact substrate section 31. Subsequently, a printing signal is sent through an electric wiring member 32 (for example, TAB) and an electric junction 33 to a recording chip 34 in the recording head, in which chip nozzles are provided.

Figure 4A:
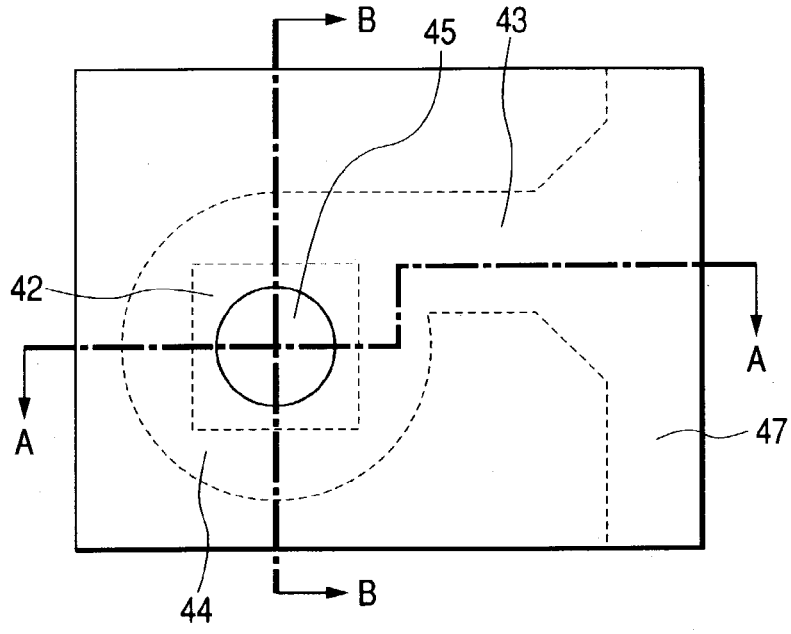
FIGS. 4A and 4B are explanatory views showing the structure of a flow channel in the ink jet recording head.
Figure 4B:
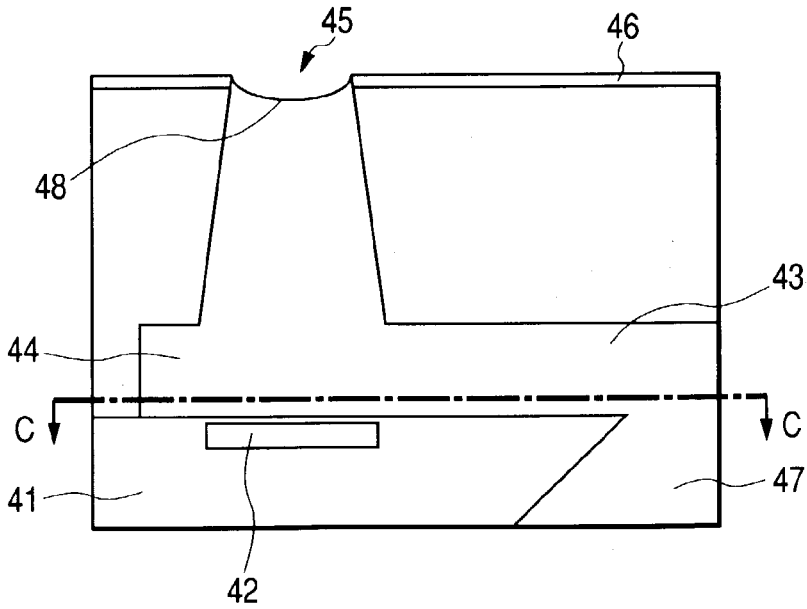
Figure 5:
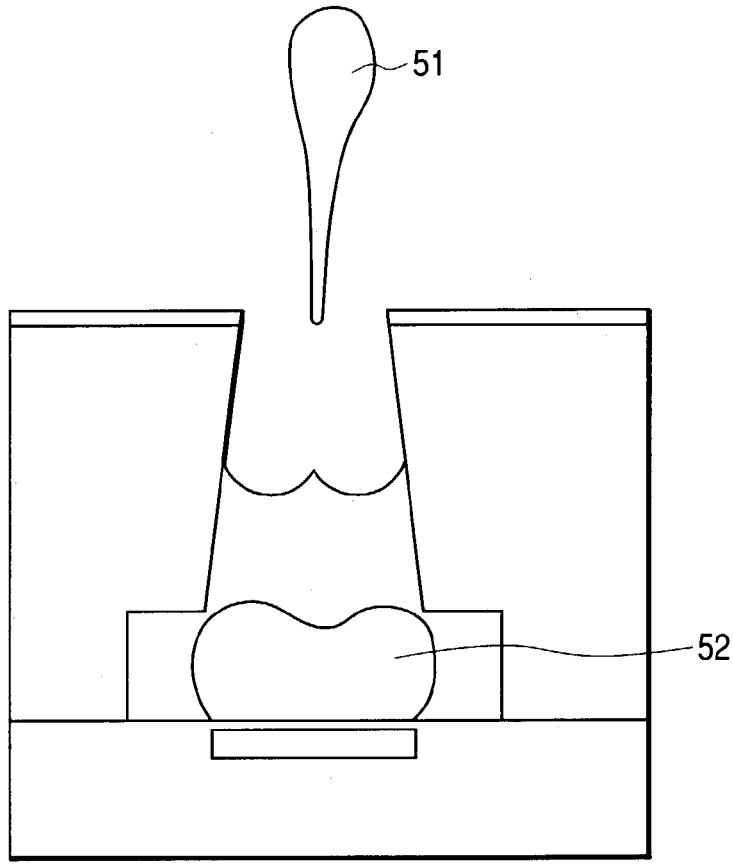
FIG. 5 is an explanatory view showing circumstances of ejecting ink.

FIGS. 4A and 4B show a nozzle shape of the recording chip 34 and a mechanism for ink ejecting will be explained, referring to the drawings. FIG. 4A shows a plan view of the nozzle shape and FIG. 4B indicates a sectional view taken along the line 4B-4B in FIG. 4A. In FIG. 4B, wires (not shown) which send the printing signal to an electric thermal conversion element 42 forming a heater element, and the like are deposited (or coated) on a substrate 41. A nozzle plate, in which a flow channel 43, a foaming chamber 44 and an ejecting port 45 are formed by a semiconductor manufacturing process, is provided on the substrate 41. Also, a water repellent film 46 is deposited (or coated) on the face surface. Ink is filled in the foaming chamber 44 from a common liquid chamber 47 through the flow channel 43 to form a meniscus 48 at the ejecting port 45. The meniscus 48 is formed under a balance between negative pressure which is caused in ink by a negative-pressure generation mechanism and the surface tension of the ink. When electricity corresponding to the printing signal energizes the electric thermal conversion element 42 forming the heater element which is provided in the foaming chamber 44, bubble are instantaneously generated by thermal energy, which is converted by the electric thermal conversion element 42, in ink filled in the foaming chamber 44. An ink droplet is ejected from the ejecting port in communication with the foaming chamber 44, using pressure changes which are generated according to growth of the bubble, for printing on a medium to be recorded. When the ink droplet is ejected and the bubble in ink is shrunk, ink enters into the foaming chamber 44 from the flow channel 43 in communication with the foaming chamber 44 and ink is filled again until the meniscus 48 is formed at the ejecting port. FIG. 5 (a sectional view taken along the line 5-5 in FIG. 4A) shows circumstances in which ink is ejected. Here, 51 indicates an ink droplet and 52 indicates a bubble.

Figure 6:
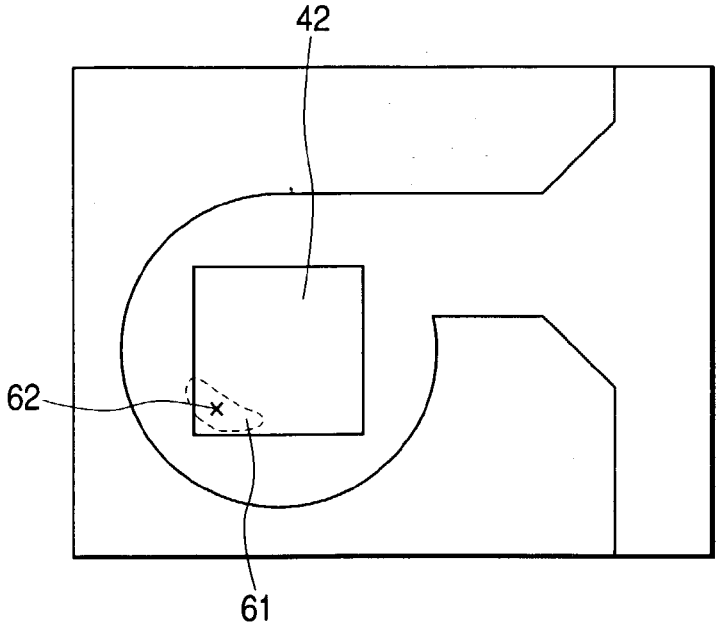
FIG. 6 is an explanatory view showing a defoaming point position.

After the ink droplet is ejected, mechanical and chemical damages are caused on the surface of the electric thermal conversion element 42 by cavitation upon defoaming of the bubble in ink as described above. When stable ejecting is continuously repeated, positions at which bubbles are defoamed on the surface of the electric thermal conversion element 42 are fixed at a fixed location and, then, damages by the cavitation are centered (or concentrated) only at the fixed location. Results of experiments which the inventors conducted for verification of the present invention are shown as follows. FIG. 6 (a sectional view taken along the line 6-6 in FIG. 4B) shows circumstances just before a bubble is defoamed. Here, 61 indicates the bubble, and 62 indicates a defoaming point position. When the number of ejections is increased, cracks and damages are caused at the defoaming point position 62 at which damages of an anti-cavitation film (not shown) which protects the electric thermal conversion element 42 are centered. When the number of ejections is further increased, the cracks and damages are enlarged and reach to the electric thermal conversion element 42 under the anti-cavitation film forming the heater element, which causes a state in which ink comes in contact with the electric thermal conversion element 42. Erosion is started on a part of the electric thermal conversion element 42 where ink is in contact and it becomes difficult for electric current to flow. Accordingly, the current flows into parts other than eroded ones and electric power concentration occurs to cause electrical breakdown (disconnection). There has been a problem that a nozzle with disconnection cannot realize the ejecting and becomes a cause of a line (or stripe) on a printed image.

Figure 1:
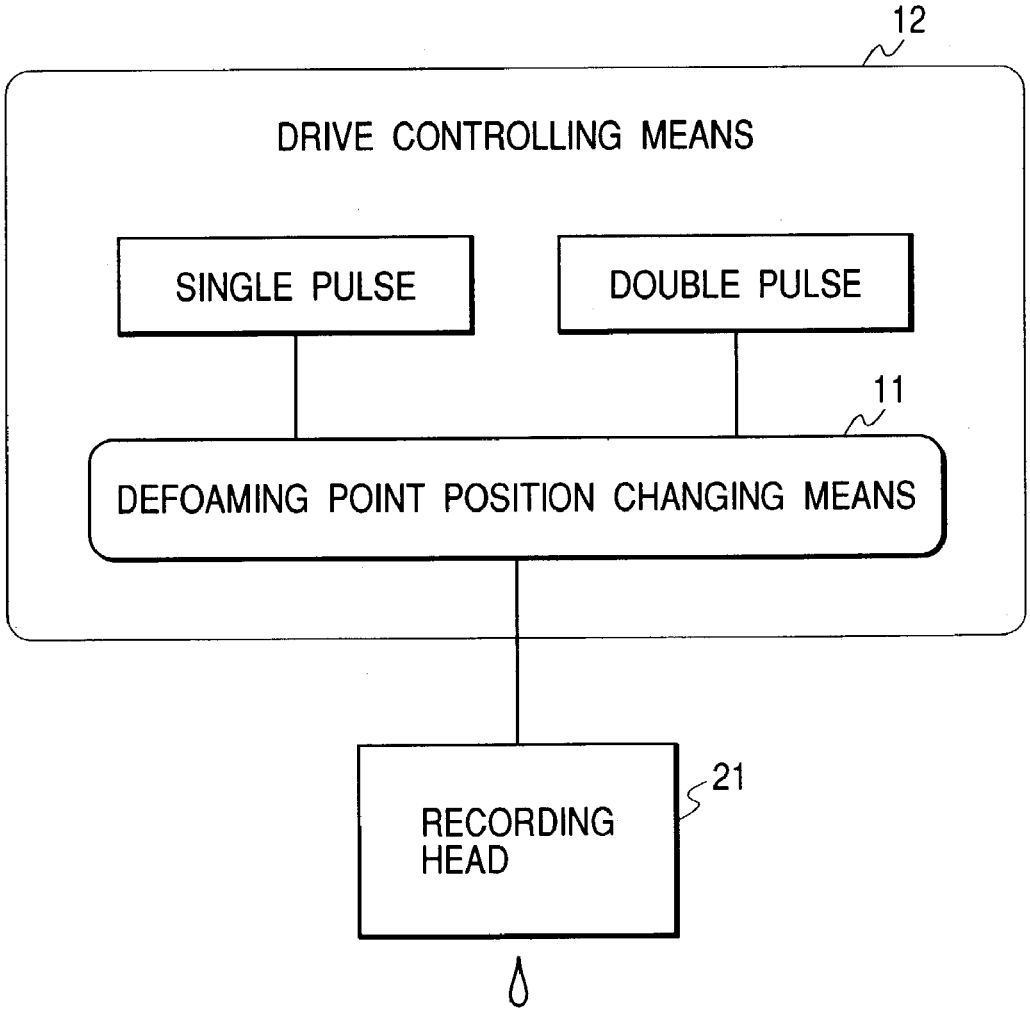
FIG. 1 is a diagram showing a block configuration of an embodiment of the present invention.

Therefore, the ink jet recording apparatus according to the present invention comprises defoaming-point-position changing means which changes a defoaming point position, by which means defoaming point positions are distributed by modulation of driving pulses at every printing of dots. FIG. 1 shows a schematic configuration of a control block in the recording apparatus of the present embodiment. Here, drive control means 12 comprises defoaming-point-position changing means 11 for changing a defoaming point position on the electric thermal conversion element 42 in the recording head 21 and realizes drive controlling of the same electric thermal conversion element 42 with the driving pulse modulated for every predetermined number of dots to be printed.

In a first embodiment of the present invention, the defoaming-point-position changing means 11 selects and switches between a double pulse or a single pulse after every predetermined number of times of ejecting as a driving pulse which forms a recording dot on a recording medium to be recorded, whereby the defoaming point position 62 is changed. The double pulse is a driving signal which executes one cycle of foaming, using a pre-pulse, a main pulse, and a down time (idle period) between the pre-pulse and the main pulse. On the other hand, the single pulse is a driving signal which executes one cycle of foaming, using only the main pulse.

Figure 7A:
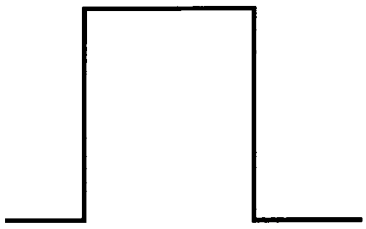
FIGS. 7A and 7B are views showing a single-pulse signal and a double-pulse signal which are supplied to a heater, respectively.
Figure 7B:
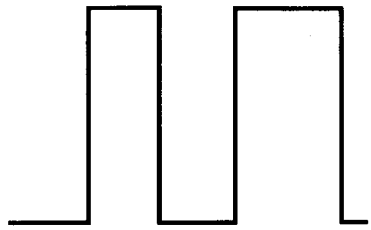
Figure 7C:
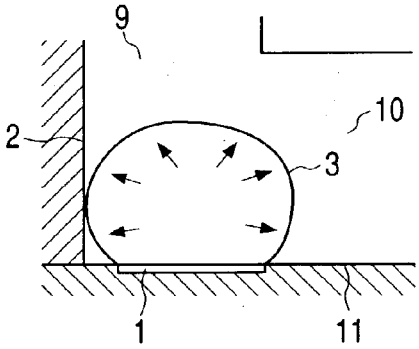
FIGS. 7C, 7D, 7E and 7F are schematic views of circumstances at foaming and defoaming of recording ink when the pulse signals are alternately supplied to the heater.
Figure 7D:
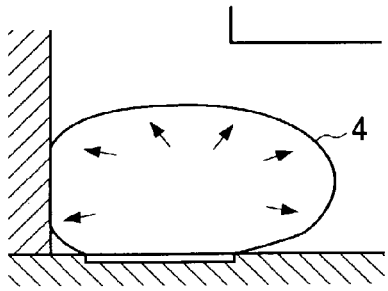
Figure 7E:
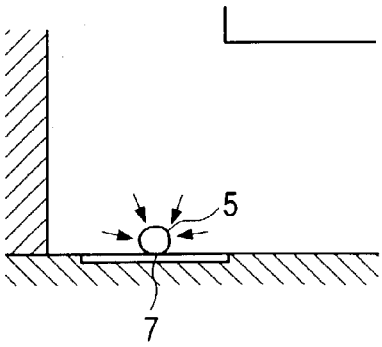
Figure 7F:
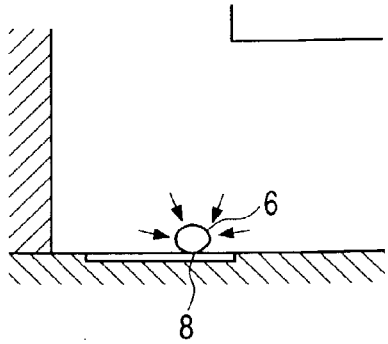

FIG. 7B shows a double-pulse signal (a two-division multiple pulse is called "double-pulse driving") which uses a preheating pulse (pre-pulse) which performs preliminary heating without generating a bubble in ink and a foaming pulse (main pulse) which generates a bubble in ink. FIG. 7A shows a single-pulse signal.

The figures are schematic views of circumstances at foaming and defoaming of recording ink when the above signals are alternately supplied to a heater.

FIGS. 7C, 7D, 7E, and 7F are exemplary views of a vertical section of the inside of the flow channel, in =which reference numeral 1 indicates the heater (heater element); 2 indicates a wall of the foaming chamber; 3 indicates a bubble at its largest size formed on the heater in the case of single-pulse driving; 4 indicates a bubble at its largest size formed on the heater in the case of the double-pulse driving; 5 indicates a bubble that has defoamed on the heater in the case of the single-pulse driving; 6 indicates a bubble that has defoamed on the heater in the case of the double-pulse driving; 7 indicates a defoaming point position of a bubble formed on the heater in the case of the single-pulse driving; 8 indicates a defoaming point position of a bubble formed on the heater in the case of the double-pulse driving; 9 indicates an ink ejecting nozzle; 10 indicates an ink supply channel; and 11 indicates a substrate provided with the heater. The wall 2 of the foaming chamber as well as the ink ejecting nozzle 9 guide the ink flow generated by foaming and function to eject the ink in the object direction. In the present embodiment, the wall 2 of the foaming chamber is configured not to be arranged at the side of the ink supply channel 10.

The double pulse will now be explained.

Figures 8A, 8B:
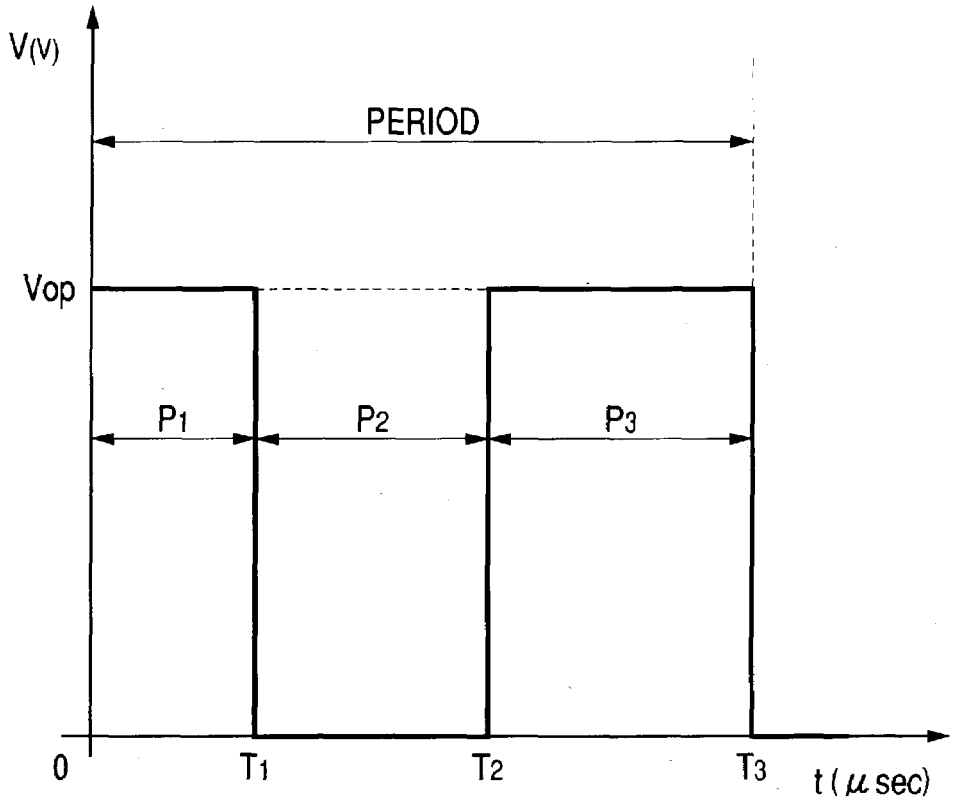
FIGS. 8A and 8B are explanatory views of a double pulse.

FIGS. 8A and 8B are explanatory views of the double pulse according to the first embodiment of the present invention. In FIGS. 8A and 8B, Vop is a driving voltage; P1 is a pulse width of a first one of a plurality of divided heat pulses (hereinafter called a "preheat pulse"); P2 is an interval time (down time); and P3 is a pulse width of a second pulse (hereinafter called a "main heat pulse"). T1, T2, and T3 indicate times which determine P1, P2, and P3, respectively. The driving voltage Vop is one of parameters expressing signal energy necessary for generation, by an electric heat converter on which the voltage is applied, of thermal energy in ink being in an ink flow channel which is formed with the substrate (heater board) and the ink foaming chamber. The voltage value is determined by an area and a value of resistance of the electric heat converter, a film structure, and a flow-channel structure of the recording head.

In a driving method according to divided-pulse width modulation, pulses with widths of P1, P2, and P3, respectively, are supplied one after another. The preheat pulse is a pulse which mainly controls the temperature of ink in the flow channel, and plays an important role in controlling a cavitation position (defoaming point position) according to the present invention. The pulse width of the preheat pulse is set such that a foaming phenomenon is not generated in ink by thermal energy generated by the electric heat converter. The interval time (down time) is provided in order to set up a predetermined time period for prevention of mutual interaction between the preheat pulse and the main heat pulse and in order to realize uniform temperature distribution of ink in the ink flow channel.

The main heat pulse has a function which generates a bubble in ink in the flow channel and ejects ink from the ejecting port and the pulse width P3 of the main heat pulse is determined by an area and a value of resistance of the electric heat converter, a film structure, and an ink-flow-channel structure of the recording head. As explained in the before-mentioned Related Background Art, ink near the surface of the ejecting heater is rapidly heated to cause a change of state from liquid to gas (film boiling) through phase transition when energy is applied to the ejecting heater. On the other hand, when the pulse width of the preheat pulse, that of the inter pulse, that of the main heat pulse, and the driving voltage are set as shown in a table of FIG. 8B, respectively, and the single pulse and the double pulse are switched and driven, independently of pulse shapes specified by recording data, (according to the explanation in the present embodiment, these pulses are alternately selected and driven) during ejecting operation for recording as described in the present embodiment, foaming states and defoaming states are different from each other, depending on differences in the driving conditions of the heater.

That is, in the case of the double-pulse driving, a foaming area becomes larger than that of the case of the single-pulse driving, because the preheat pulse has an effect to raise the temperature of ink in the flow channel. Thereby, with regard to a defoaming point position (position of cavitation), a position 7 in the case of the single-pulse driving and a position 8 in the case of the double-pulse driving are different from each other and the positions are not centered on a fixed location.

Figure 9:
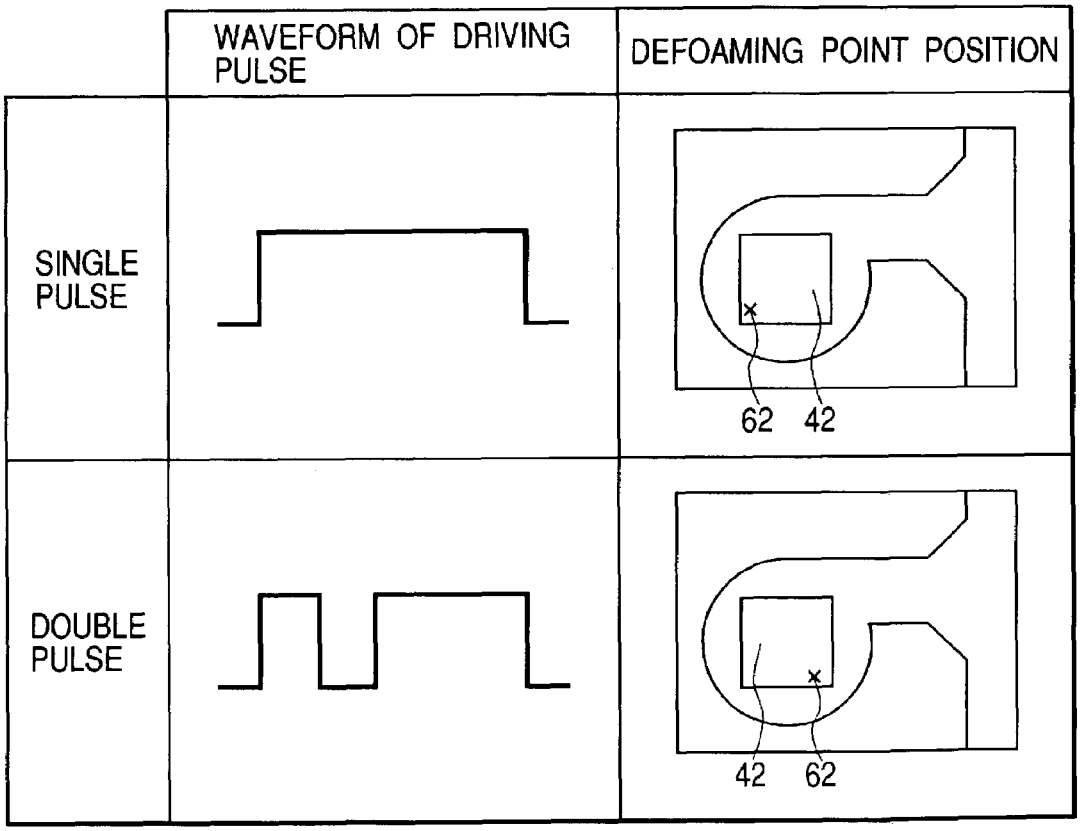
FIG. 9 is an explanatory view of waveforms of driving signals and defoaming point positions.

FIG. 9 shows a view of the defoaming point positions seen from the upper side of the flow channel in a case where the single pulse and the double pulse are used.

Defoaming point positions 62 corresponding to each of the pulses are located at different positions on the electric thermal conversion element 42, respectively, as shown in FIG. 9. In order to prevent damages caused by cavitation from centering on the heater element including the electric thermal conversion element, the defoaming-point-position changing means 11 can distribute the defoaming point positions 62 by printing while either the single pulse or the double pulse is selected so that the defoaming point positions 62 are different from each other for every printing dot.

Thus, since the heater element is driven in the present embodiment while driving conditions are changed, independently of the recording data, after every driving event of the same heater element (every ejecting operation) upon switching of the driving operation, it is possible to distribute the defoaming point positions on the heater element, to suppress reduction in the lifetime, which is caused by cavitation damages, to avoid deterioration in recorded images due to breakdown of the heater element, and to obtain excellent images over a long period of time.

An example, in which the driving conditions of the same heater element are alternately switched after every ejecting operation between the single-pulse driving and the double-pulse driving, has been explained in this embodiment. However, the switching may be executed not alternately, but after every predetermined number of ejecting operations. Since uneven ejection due to switching of driving signals is easily noticed when the predetermined number of ejecting operations becomes too large, it is preferable that the number is smaller. Also, the predetermined number may be randomly set without using a fixed number.

Second Embodiment

A second embodiment of the present invention will now be explained.

A driving method, in which a single pulse and a double pulse are alternately applied on the same ejecting heater to prevent the cavitation positions from centering at a fixed location, has been explained in the above-described first embodiment. In this embodiment, a pulse width of an applied pulse is changed to prevent defoaming point positions (generation position of cavitation) from centering at a fixed location.

More particularly, the feature of the present embodiment is to change as a driving condition the pulse width of a foaming pulse for generating a bubble in ink.

Figure 10A:
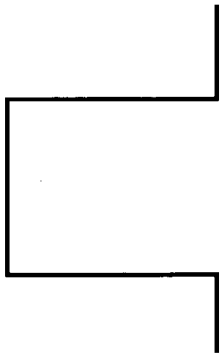
FIGS. 10A, 10B and 10C are conceptual views showing pulse signals supplied to the heater.
Figure 10B:
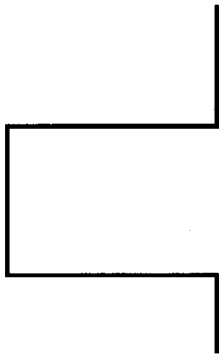
Figure 10C:
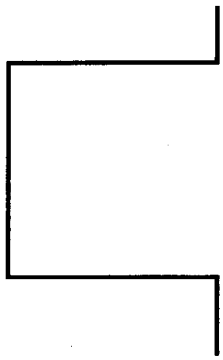
Figure 10D:
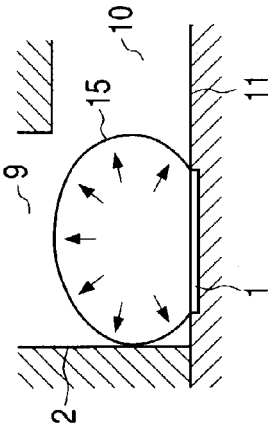
FIGS. 10D, 10E, 10F, 10G, 10H and 10I are conceptual views of circumstances at foaming and defoaming of recording ink when the pulse signals are supplied to the heater, respectively.
Figure 10E:
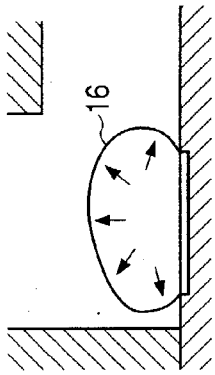
Figure 10F:
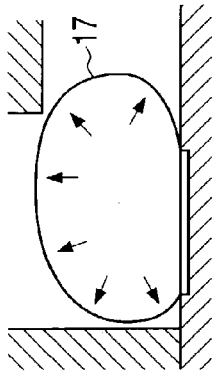
Figure 10G:
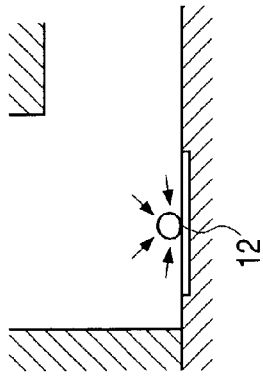
Figure 10H:
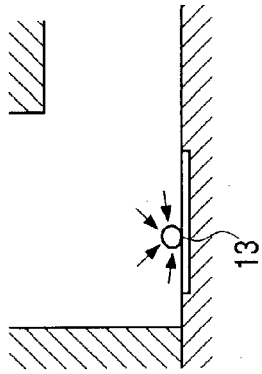
Figure 10I:
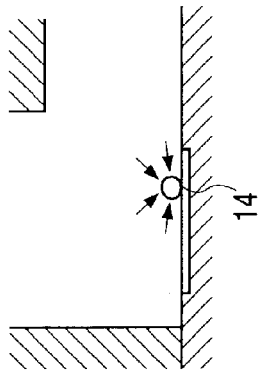

FIGS. 10D, 10E, 10F, 10G, 10H and 10I are conceptual views showing circumstances of foaming and defoaming of recording ink when foaming pulses for heating, which are provided with different pulse widths, respectively, as shown in FIGS. 10A, 10B and 10C, are supplied to the heater.

Reference numeral 1 indicates a heater element (heater); 2 indicates a wall of a foaming chamber; 15, 16 and 17 indicate bubbles on the heater element at their largest sizes when the electric thermal conversion element forming the heater element is driven with respectively different pulse widths; 12, 13 and 14 indicate defoaming positions of bubbles on the heater when the electric thermal conversion element is driven with respectively different pulse widths; 9 indicates an ink ejecting nozzle; 10 indicates an ink supply channel; and 11 indicates a substrate provided with the heater element.

When forming pulses with pulse widths different from each other, as shown in FIGS. 10A, 10B and 10C, are supplied to the heater element, respectively, as explained in the present embodiment, the circumstances of foaming and defoaming are different from each other, depending on the differences in the pulse width.

That is, when the electric thermal conversion element forming the heater element is driven with a longer pulse width, a foaming area becomes larger than that of a case where the element is driven with a shorter pulse width. Following the above, with regard to the defoaming point position (position of cavitation), the position 14 when the electric thermal conversion element is driven with a longer pulse width and the position 13 when the electric thermal conversion element is driven with a shorter pulse width are different from each other. Accordingly, the defoaming point positions are not centered on a fixed location. Thus, the defoaming point positions are made unstable through driving with different driving conditions for each driving event in order to prevent cavitation positions on the heater from centering at a certain point. As a result, it is possible to suppress the reduction in the lifetime of the ejecting heater caused by cavitation damages, to avoid deterioration in recorded images due to the disconnection in the heater, and to obtain stable image quality.

Third Embodiment

A third embodiment of the present invention will now be explained.

Figure 11:
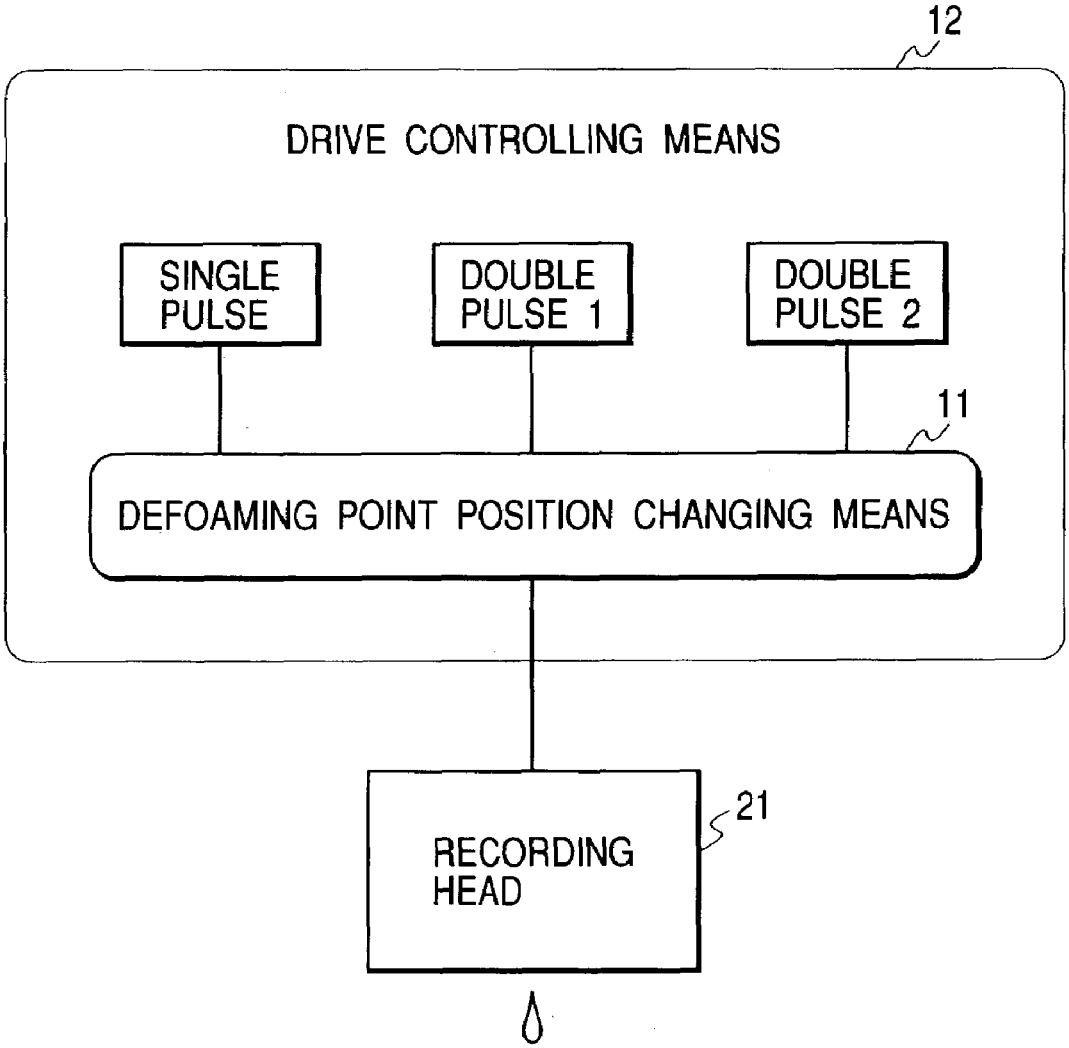
FIG. 11 is a diagram showing a block configuration of another embodiment of the invention.

FIG. 11 shows a schematic block configuration of the present embodiment. As with the previous embodiments, driving control means 12 comprises defoaming-point-position changing means 11 for changing a defoaming point position 62 on an electric thermal conversion element 42 in a recording head 21 and realizes drive controlling of the electric thermal conversion element 42 with a driving pulse modulated for every printing dot. Moreover, printing is executed by random selection of two or more kinds of driving pulses obtained by modulating at least one of a pre-pulse, a main pulse and an interval time of a double pulse by two steps or more.

Figure 12:
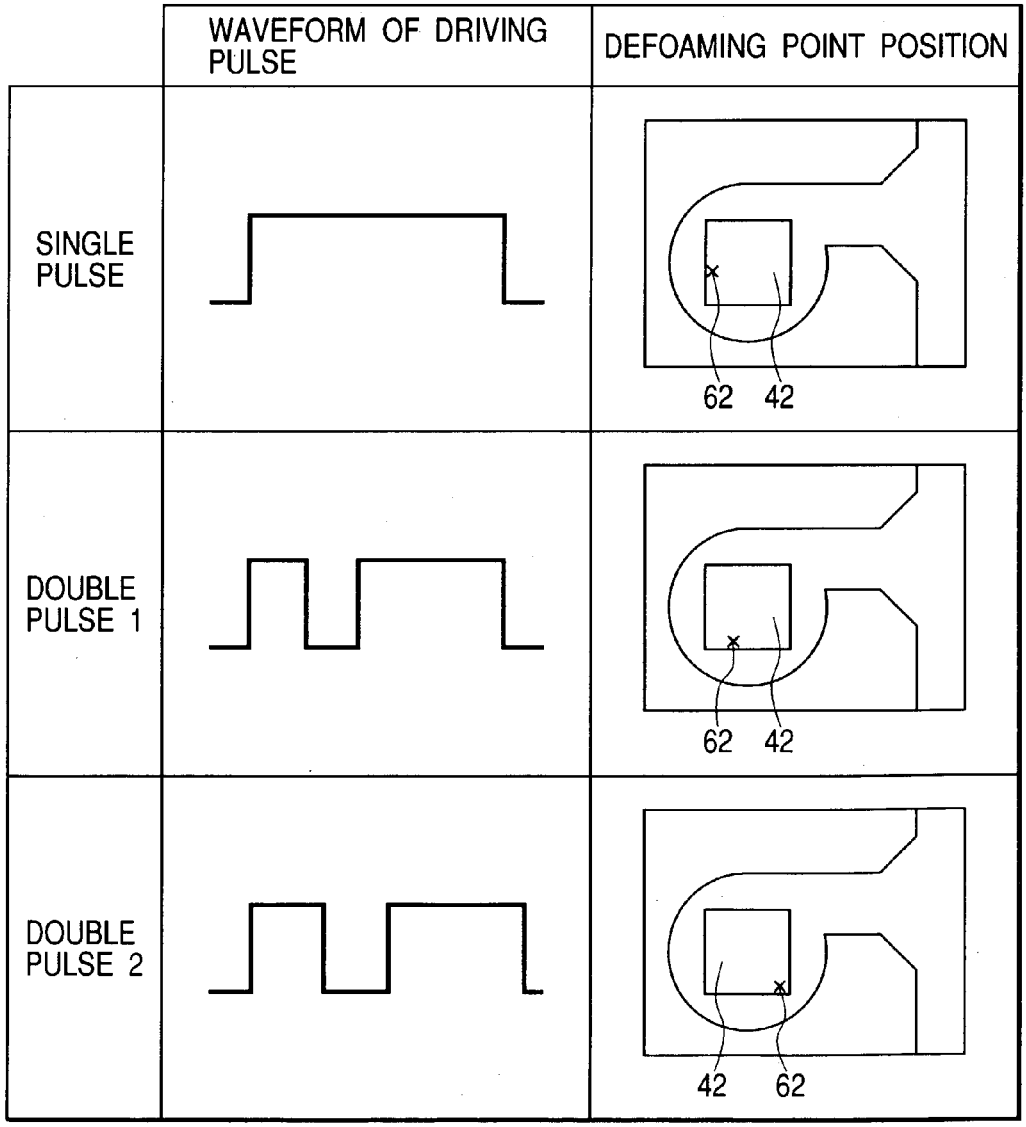
FIG. 12 is an explanatory view of waveforms of driving signals and defoaming point positions.

Hereinafter, a case where two-step modulation of a double pulse is executed (for simplification, two modulated double pulses are called a "double pulse 1" and a "double pulse 2") and one of the double pulse 1, the double pulse 2, and a single pulse is selected for every printing dot (every ejecting operation) for printing will be explained. FIG. 12 shows a schematic view of the waveforms of each pulse. Conditions for applying time are different, depending on the two driving pulses, to cause different growth and shrinkage of a bubble in ink, respectively. Thereby, the bubbles in ink can be defoamed at positions different from each other on the electric thermal conversion element 42, as shown in FIG. 12, when each driving pulse is applied. When printing is executed by the defoaming-point-position changing means 11, while any of three driving pulses with different defoaming point positions 62 is randomly selected for every printing dot, the defoaming point positions 62 can be distributed to three locations. That is, cracks or damages in the anti-cavitation film are reduced by about one third even with the same number of ejections in the case of the present invention, in comparison with that of a conventional case in which damages caused by cavitation are centered at one location. In other words, the durability can be increased by about three times.

As shown in the present embodiment, the defoaming point positions 62 can be distributed to a plurality of locations by executing printing while one of two or more driving pulses with different defoaming point positions 62 on the electric thermal conversion element 42 is selected for every printing dot. Thereby, since damages to one location can be reduced by distributing the damages to the plurality of locations in comparison with a conventional case in which damages caused by cavitation are centered at one location, it is possible to provide an ink jet recording apparatus with long durability and reliability.

Though two-step modulation of a double pulse has been executed in the above explanation, the object of the present invention may be realized even by three-or-more-step modulation, such that the defoaming point positions are differently located from each other. Obviously, the invention is not limited only to the above-described embodiments. Also, though the above explanation has referred to the double pulse, two-or-more-step modulation of a single pulse may be applied as explained in the second embodiment.

Fourth Embodiment

In the case of multistep modulation of a driving pulse to be conducted such that defoaming point positions 62 are different from each other, there are some situations in which a desired printing density with a predetermined ink amount cannot be obtained when printing is executed using a driving pulse with an ink amount which is less or more than that within a predetermined range.

Figure 13:
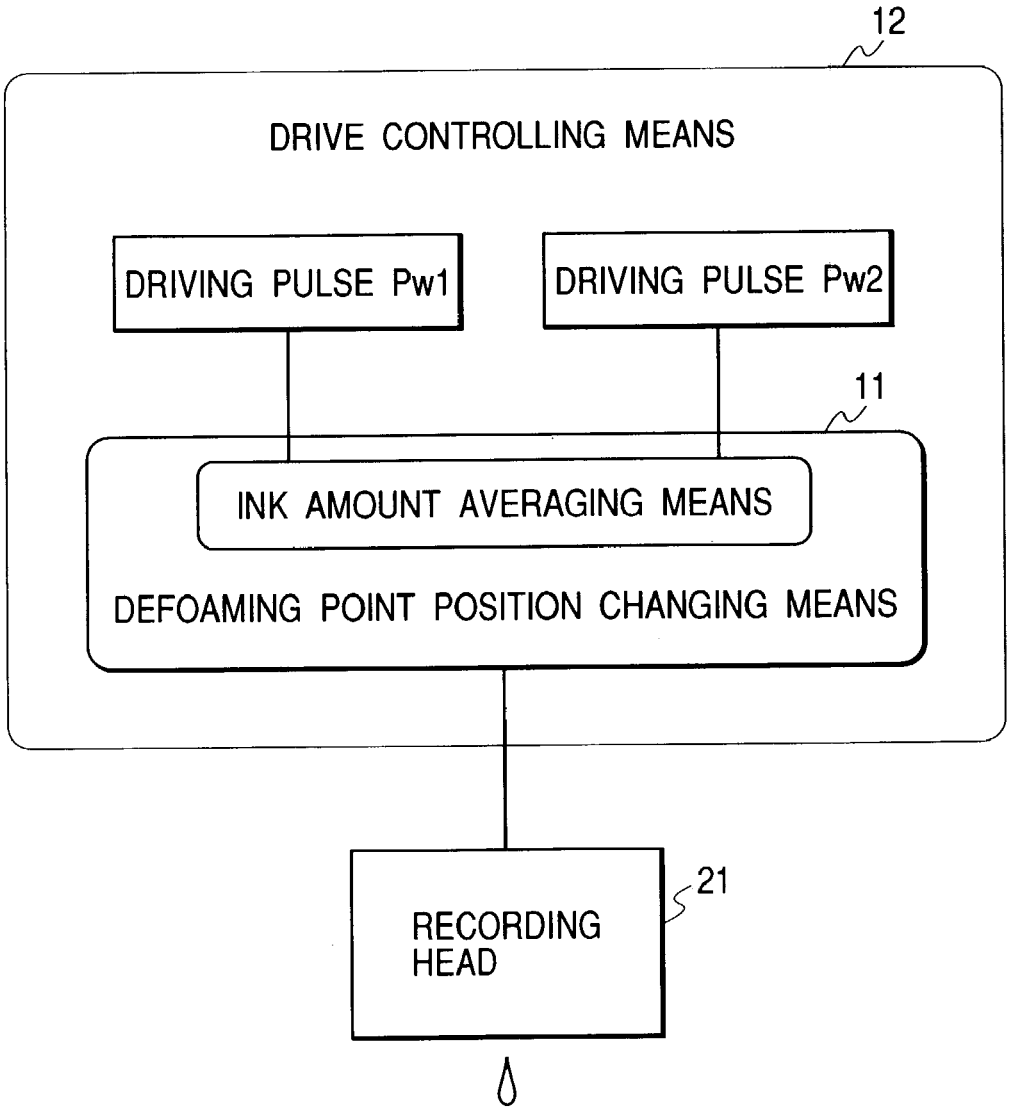
FIG. 13 is a diagram showing a block configuration of still another embodiment of the invention.

In the present embodiment, a defoaming-point-position changing means 11 is provided with ink-amount averaging means, as shown in FIG. 13, in order to solve the above-described problems. When printing is executed by using a driving pulse Pw1 by which an ink amount Vd1 less than a predetermined ink amount Vdref is ejected and a driving pulse Pw2 by which an ink amount Vd2 exceeding the predetermined ink amount Vdref is ejected, the ink-amount averaging means selects a driving pulse, based on a ratio of $Pw1:Pw2=\alpha:(1-\alpha)$ by which ratio $Vdref=\alpha\cdot Vd1+(1-\alpha)\cdot Vd2$ is valid, wherein $\alpha$ is a variable from 0 to 1. Thereby, a printed ink amount after averaging becomes the predetermined ink amount and printing can be realized with approximately the same printing density as that of a case where printing is executed with the predetermined ink amount.

According to the present embodiment, it is possible, as well as with the above-described embodiments, to provide an ink jet recording apparatus which has long durability and reliability, and can realize printing with predetermined density.

Here, the averaging is not limited to that between two driving pulses and the above averaging may be executed among a larger number of driving pulses.

Fifth Embodiment

A fifth embodiment of the present invention will now be explained.

A feature of the present embodiment is to change, for every driving event, a driving voltage of a foaming pulse for heating, which voltage generates a bubble in ink.

In the above-described first embodiment, a driving method in which a single pulse and a double pulse are alternately applied to the same ejecting heater to prevent cavitation points from centering at a fixed location has been applied. Also, in the second to fourth embodiments, a driving method in which a pulse width applied to a recording head is changed for every driving event to prevent cavitation points from centering at a fixed location has been applied. In the present embodiment, a voltage applied to the recording head is changed for every driving event to prevent cavitation points from centering at a fixed location as hereinafter described.

Figure 14A:
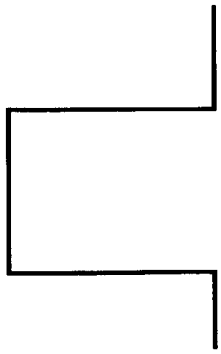
FIGS. 14A, 14B and 14C are conceptual views showing pulse signals supplied to the heater.
Figure 14B:
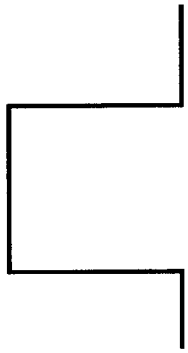
Figure 14C:
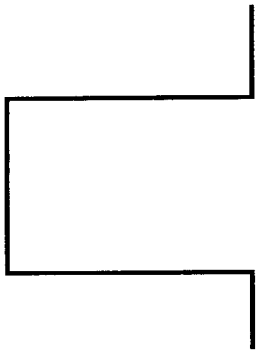
Figure 14D:
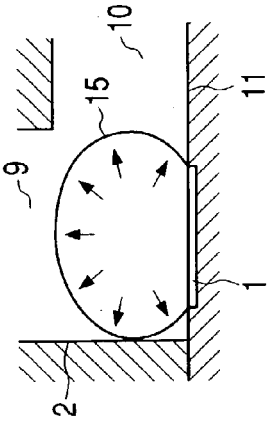
FIGS. 14D, 14E, 14F, 14G, 14H and 14I are conceptual views of circumstances at foaming and defoaming of recording ink when the pulse signals are supplied to the heater, respectively.
Figure 14E:
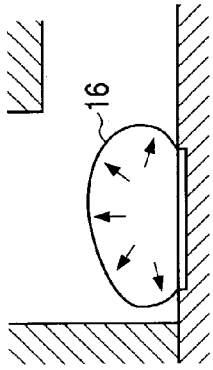
Figure 14F:
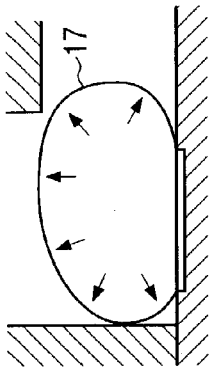
Figure 14G:
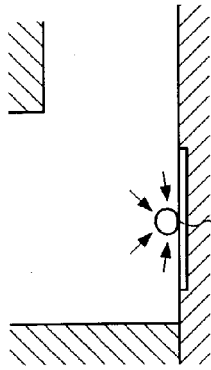
Figure 14H:
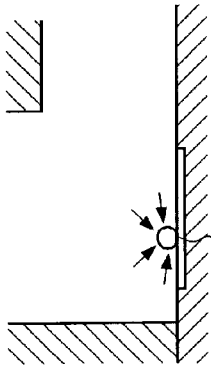
Figure 14I:
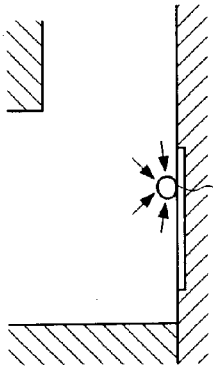

FIGS. 14D, 14E, 14F, 14G, 14H and 14I are conceptual views showing circumstances of foaming and defoaming of recording ink when foaming pulses for heating with different driving voltages, respectively, as shown in FIGS. 14A to 14C, are supplied to the heater.

Even in the present embodiment, the circumstances of foaming and defoaming are different from each other by changing the driving voltages for every driving event, as with the second embodiment. That is, when the heater is driven with a high voltage, a foaming area becomes larger than that of a case where the heater is driven with a low voltage. Accordingly, the defoaming point positions (cavitation positions) are not centered on a fixed location as shown in FIGS. 14D to 14I. Thus, the defoaming point positions are made unstable in order to prevent cavitation positions on the heater through driving with different driving conditions for each driving event. As a result, it is possible to extend the lifetime with regard to disconnection in the ejecting heater caused by cavitation damages, to avoid deterioration in recorded images due to the disconnection in the heater, and to obtain stable image quality.

As clearly described above, according to the present invention, the cavitation positions are configured not to be centered on a fixed location by preventing defoaming point positions from centering on a fixed location on the heater through driving with different driving conditions for every ejecting driving when the heater as a heater element is repeatedly driven in recording by the ink jet recording apparatus. Thereby, an advantage can be obtained in that the lifetime of the heater can be increased.

What is claimed is:

1. An ink jet recording apparatus comprising:

a plurality of heater elements for heating ink upon driving the heater elements to eject the ink;

control means for controlling driving of the same heater elements for recording by providing a pulse different from a preceding pulse for each ejection operation, independently of image data; and ink-amount averaging means arranged to select pulses to be used by said control means so that the average of ink amounts based on the pulses becomes a predetermined ink amount, wherein said control means controls the driving by using the pulses selected through said ink-amount averaging means, wherein said ink-amount averaging means is arranged to select the pulses based on a ratio of $Pw1:Pw2=\alpha:(1-\alpha)$ by which ratio $Vdref=\alpha\cdot Vd1+(1-\alpha)\cdot Vd2$ is valid, where Pw1 is a driving pulse by which an ink amount Vd1 less than a predetermined ink amount Vdref is ejected, and Pw2 is a driving pulse by which an ink amount Vd1 exceeding the predetermined ink amount is ejected, wherein $\alpha$ is a variable from 0 to 1.

2. The ink jet recording apparatus according to claim 1, wherein said control means also functions as defoaming-point-position changing means for changing defoaming point positions of bubbles generated by driving said heater elements by changing driving conditions.

3. The ink jet recording apparatus according to claim 1, wherein each ejecting operation is an ejecting operation for recording on a medium to be recorded.

4. The ink jet recording apparatus according to claim 1, wherein said control means controls the same heater elements by switching between a case where only a main pulse for generating a bubble in ink is used and a case where two or more pulses comprised of a preheating pulse for executing preliminary heating without generating a bubble in ink and the main pulse are used.

5. The ink jet recording apparatus according to claim 1, wherein a driving signal for driving said heater elements comprises a main pulse for generating a bubble in ink, a preheating pulse for executing preliminary heating without generating a bubble in ink, and a down time between the main pulse and the preheating pulse, and wherein said control means controls so as to change at least one of the main pulse, the preheating pulse and the down time as one of the driving conditions.

6. The ink jet recording apparatus according to claim 1, wherein said control means changes a pulse width of a driving pulse for generating a bubble in ink and supplies the driving pulse to the same heater element.

7. The ink jet recording apparatus according to claim 1, further comprising means for changing an applying timing of a main pulse for generating a bubble in ink and supplying the main pulse to the same heater element.

* * * * *

UNITED STATES PATENT AND TRADEMARK OFFICE

CERTIFICATE OF CORRECTION

PATENT NO. : 7,270,389 B2
APPLICATION NO. : 10/424095
DATED : September 18, 2007
INVENTOR(S) : Inoue et al.

Figure 15A:
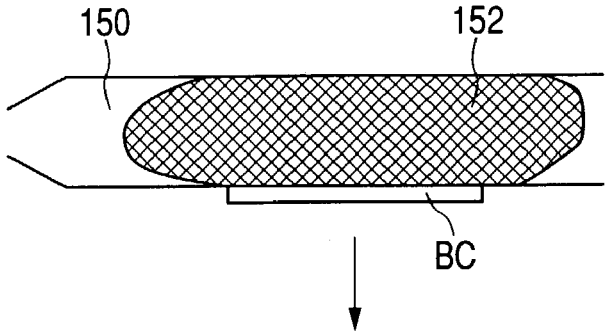
FIGS. 15A, 15B, 15C, 15D are explanatory views of the physics of cavitation.
Figure 15B:
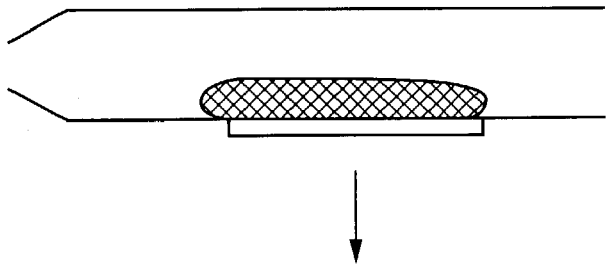
Figure 15C:
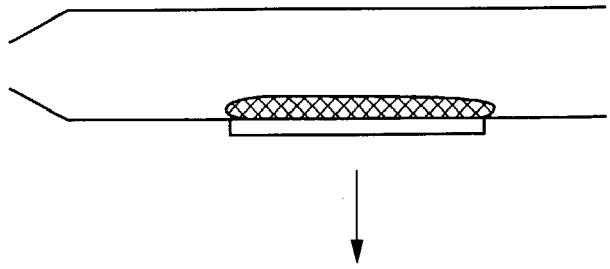
Figure 15D:
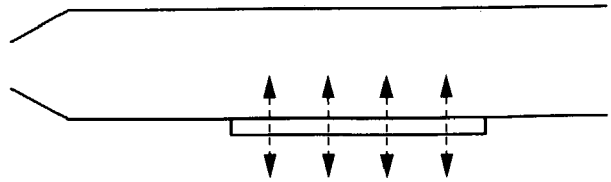

It is certified that error appears in the above-identified patent and that said Letters Patent is hereby corrected as shown below:

IN THE DRAWINGS:
Sheet 4, FIG. 4A, "A" (both occurrences) should read --4B--, and "B" (both occurrences) should read --5--.
Sheet 4, FIG. 4B, "C" (both occurrences) should read --6--.
Sheet 14, FIG. 15A, "BC" should read --8C--.

COLUMN 5:
Line 56, "=which" should read --which--.

Signed and Sealed this

Seventeenth Day of March, 2009

JOHN DOLL
*Acting Director of the United States Patent and Trademark Office*